US011686322B1

(12) United States Patent
Yao

(10) Patent No.: US 11,686,322 B1
(45) Date of Patent: Jun. 27, 2023

(54) QUICK BUCKLE STRUCTURE OF CEILING FAN BLADE

(71) Applicant: Chao Chin Yao, Taichung (TW)

(72) Inventor: Chao Chin Yao, Taichung (TW)

( * ) Notice: Subject to any disclaimer, the term of this patent is extended or adjusted under 35 U.S.C. 154(b) by 0 days.

(21) Appl. No.: 17/649,182

(22) Filed: Jan. 27, 2022

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 29/34; F04D 25/088
See application file for complete search history.

(56) References Cited

U.S. PATENT DOCUMENTS 6,378,824 B1 * 4/2002 Tseng ..... F04D 29/34 248/220.21
2003/0228224 A1 * 12/2003 Lee ..... F04D 25/088 416/206
2015/0300364 A1 * 10/2015 Lin ..... F04D 29/34 416/221

* cited by examiner

*Primary Examiner* — Michael L Sehn
(74) *Attorney, Agent, or Firm* — Muncy, Geissler, Olds & Lowe, P.C.

(57) ABSTRACT

A quick buckle structure of a fan blade of a ceiling fan comprises a base fixed on a rotor of a ceiling fan motor, wherein the base is provided with a bottom wall and a front wall, the front wall is provided with an insertion opening, the bottom wall is provided with a guide rail part adjacent to the insertion opening, and the bottom wall is provided with a fixing frame located above the guide rail part. The fan blade is inserted into the insertion opening with a tongue part, wherein the tongue part extends along the guide rail part. The tongue part is provided with a base area located behind the fixing frame, a stop block is integrally erected on the base area, and the stop block abuts against the fixing frame so that the fan blade cannot exit from the insertion port.

5 Claims, 8 Drawing Sheets

QUICK BUCKLE STRUCTURE OF CEILING FAN BLADE

FIELD OF THE INVENTION

The present disclosure relates to a ceiling fan, in particular to a quick buckle structure of a ceiling fan blade.

BACKGROUND OF THE INVENTION

A ceiling fan is an optional device to adjust the air convection state in an indoor space. It is suspended from the ceiling and generates wind by the rotation of the blades. Due to the large size of ceiling fans, they are usually split into multiple components, such as blade bases and blades, and packaged together for sale, so that consumers can take out the components after bringing them home, and combine them one-by-one into a finished ceiling fan.

As mentioned above, the blade is not integrally formed with the blade base, but is connected by fixing components such as screws, so tools become necessary during the assembly process to complete the connection between the components. In this case, manufacturers must provide tool kits with the correct specifications and quantities in the product package, however, omissions of the tool kits are likely to occur. Furthermore, it will be difficult and time-consuming to correctly assemble the ceiling fan for the consumer.

Based on the above problems, the industry has introduced a quick buckle structure between the blade and the blade base. The assembly can be completed simply by inserting the blade into the blade base, which makes the assembling process very simple. However, the ceiling fan uses a motor to drive the blades to rotate, so the blades will continue to be subjected to centrifugal force during operation. If the connection between the blades and the blade base is not stable enough, the blades may be thrown out which should be a potential security concerns for users.

SUMMARY OF THE INVENTION

The main object of the present disclosure is to provide a quick buckle structure of a ceiling fan blade, which can assemble the fan blade on the turntable of the ceiling fan without using tools, so that a quick assembly and improved joint stability can be achieved.

To achieve the foregoing objective, the present disclosure provides a quick buckle structure of a fan blade of a ceiling fan, including:

a base fixed on a rotor of the fan motor, wherein the base is provided with a bottom wall and a front wall, the front wall is provided with an insertion opening, the bottom wall is provided with a guide rail part adjacent to the insertion opening, and a fixing frame located behind the guide rail is arranged on the bottom wall;

a blade, which is inserted into the insertion opening with a tongue part, wherein the tongue extends along the guide rail, the tongue is provided with a base area located behind the fixing frame, a stop block is integrally erected on the base area, and the stop block abuts against the fixing frame so that the fan blade cannot exit from the insertion port.

Preferably, wherein a recess part is provided at the periphery of the insertion opening, and the tongue part of the fan blade is provided with a protrusion whose position and shape correspond to the recess part so that the tongue part can be inserted into the insertion opening in a specific orientation Preferably, the fan blade passes through the tongue part with a bolt and is locked to the guide rail part.

The above mentioned fixing frame includes a bottom portion integrally connected to the bottom wall, and a top plate locked to the bottom portion by a screw, and the stop block abuts against the top plate so that the fan blade cannot exit from the insertion port.

Further, the stop block is provided with a wedge face facing the insertion direction of the tongue part, and an upright face facing away from the insertion direction of the tongue part, in the process of inserting the tongue part into the insertion opening, the wedge face abuts against the top plate and guides the stop block to pass through the top plate, and the upright face is blocked by the top plate after passing through the top plate so that the fan blade cannot exit from the insertion port.

The above mentioned top plate is provided with a through hole, and the upright face of the stop block extends into the through hole and abuts against the hole edge of the through hole.

DETAILED DESCRIPTION OF THE PREFERRED EMBODIMENTS

Figure 1:
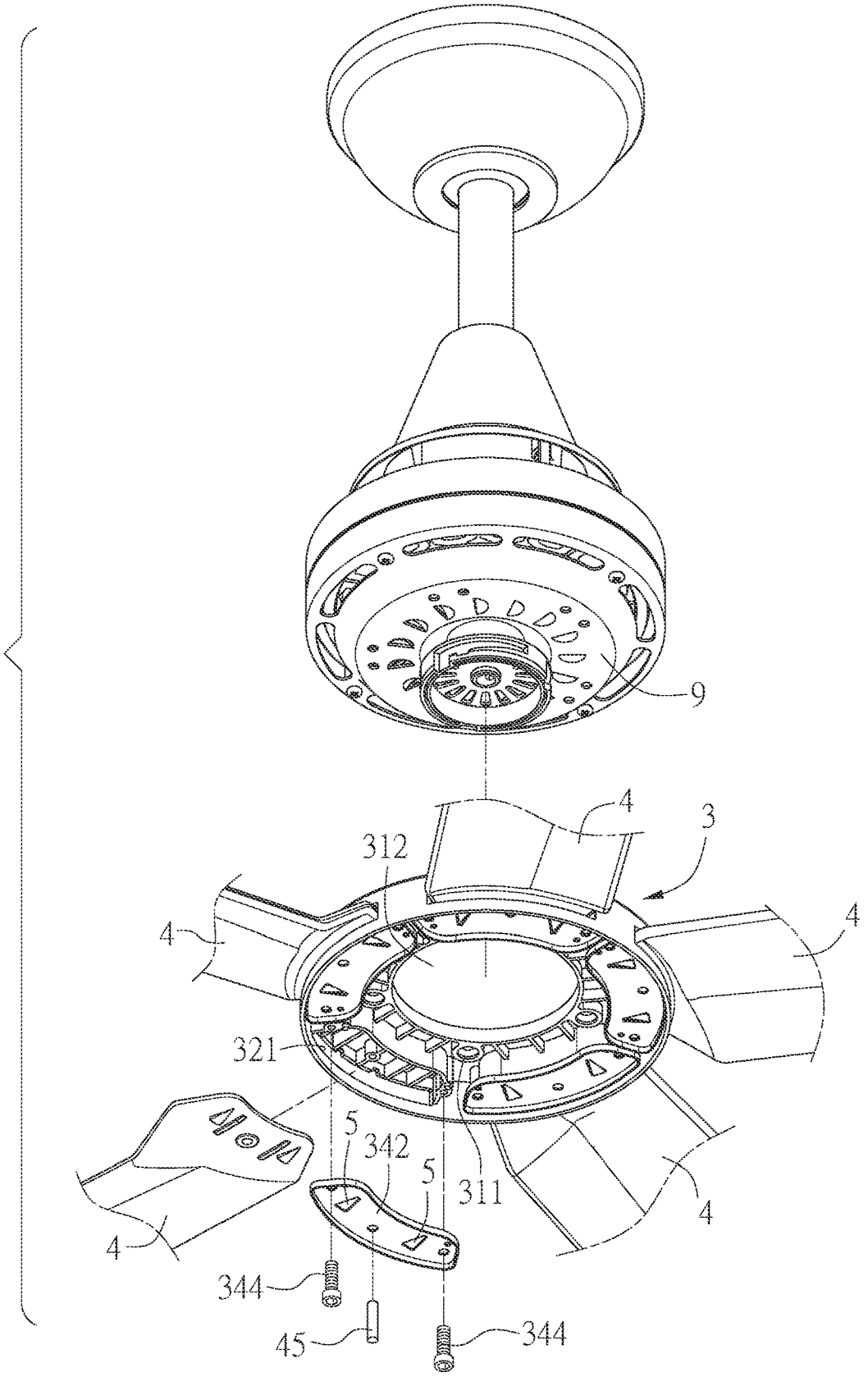
FIG. 1 is a perspective view of the present disclosure.
Figure 2:
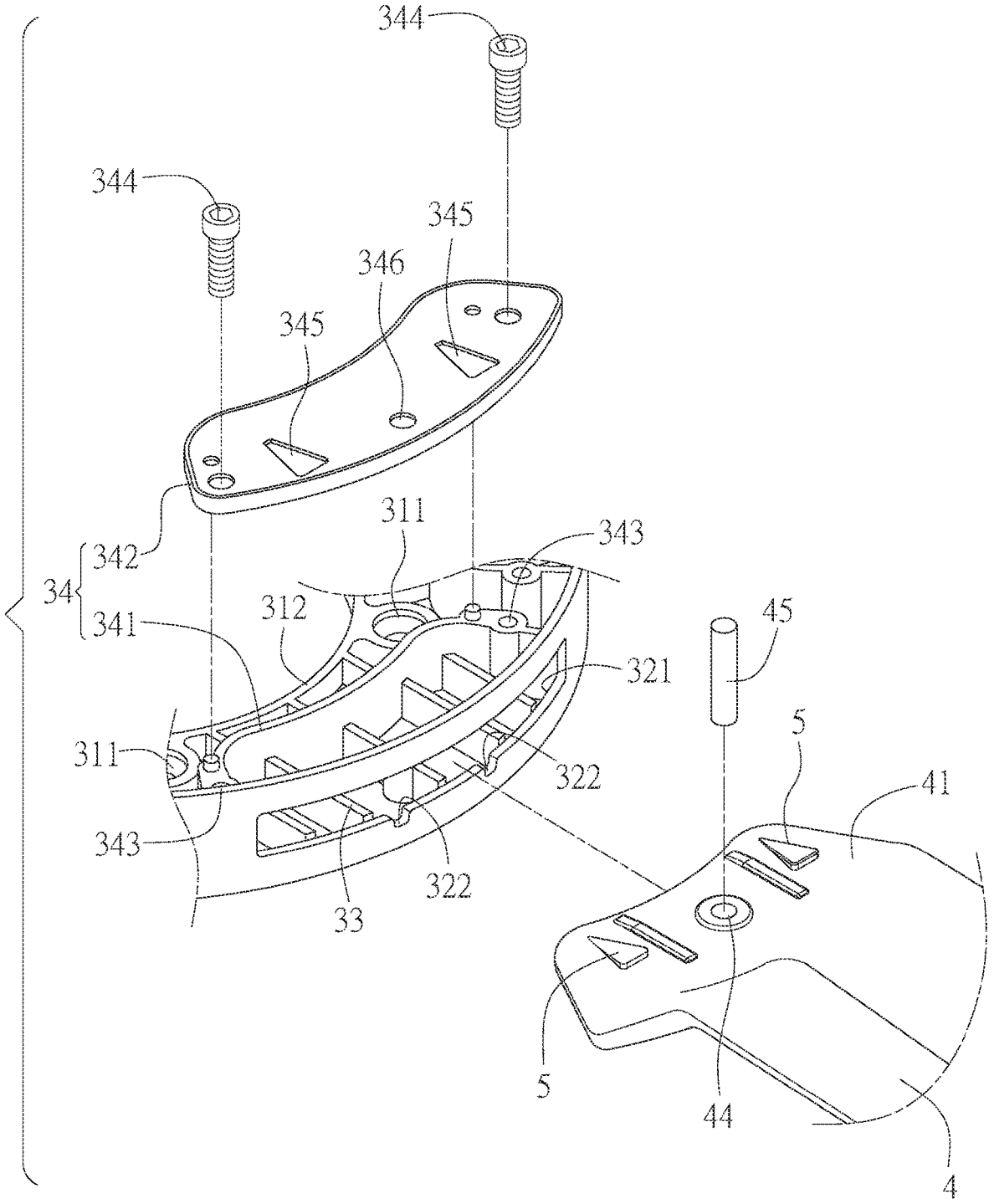
FIGS. 2 and 3 are schematic perspective exploded views of the present disclosure.
Figure 3:
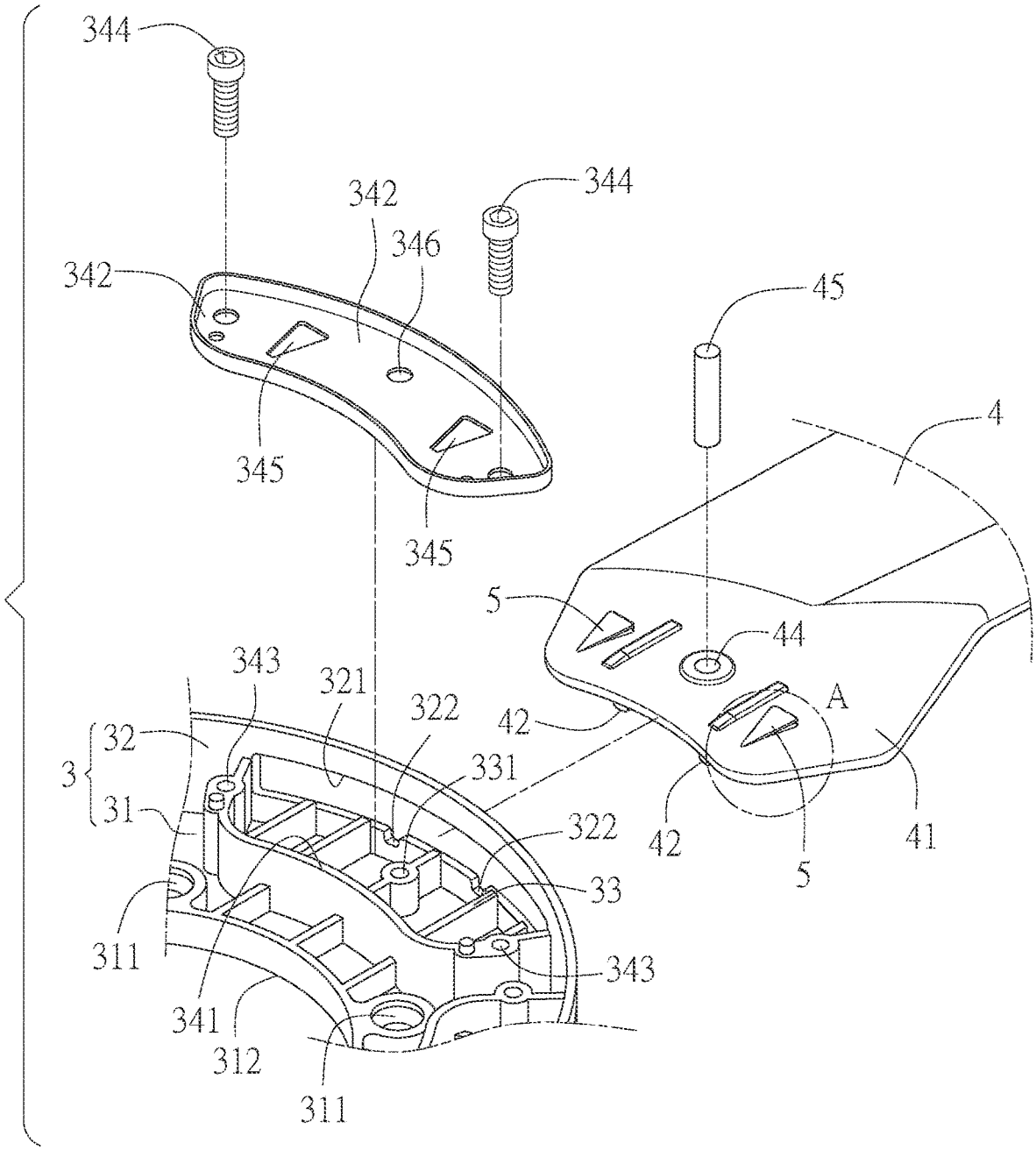

Referring to FIG. 1 to FIG. 3, show the quick buckle structure of the ceiling fan blade provided by the present disclosure, which includes a base 3 and a plurality of fan blades 4. The base 3 is a circular disk body having a bottom wall 31 and a front wall 32 standing on the periphery of the bottom wall 31, the bottom wall 31 is provided with a plurality of fixing holes 311 through which screws pass so that the bottom wall 31 could be locked on the motor 9 of the ceiling fan, and in particular, be locked on the motor of the ceiling fan, a circular hole 312 is formed in the center of the bottom wall 31 for allowing the motor 9 to extend.

The base 3 defines an equal number of regions according to the number of fan blades 4, and the regions are respectively used to assemble a fan blade 4; in this embodiment, the number of the fan blades 4 is five, and five assembling regions are defined on the base 3. The front wall 32 is provided with a flat insertion opening 321 in each region, and the shape of the insertion opening 321 corresponds to the cross-sectional shape of the fan blade 4 for the insertion of the fan blade 4. The bottom wall 31 is provided with a guide rail part 33 and a fixing frame 34 in each region, both of which are located at the same line as the insertion opening 321. The guide rail part 33 is adjacent to the insertion opening 321 for guiding the moving direction of the fan blade 4 after being inserted into the insertion opening 321. The fixing frame 34 includes a bottom part 341 and a top plate 342, wherein the bottom part 341 is integrally connected to the bottom wall 31, and the bottom part 341 is provided with a locking hole 343 for locking the top plate 342 to the bottom part 341 with the screw 344, thereby suspending the top plate 342 above the guide rail part 33.

Figure 4:
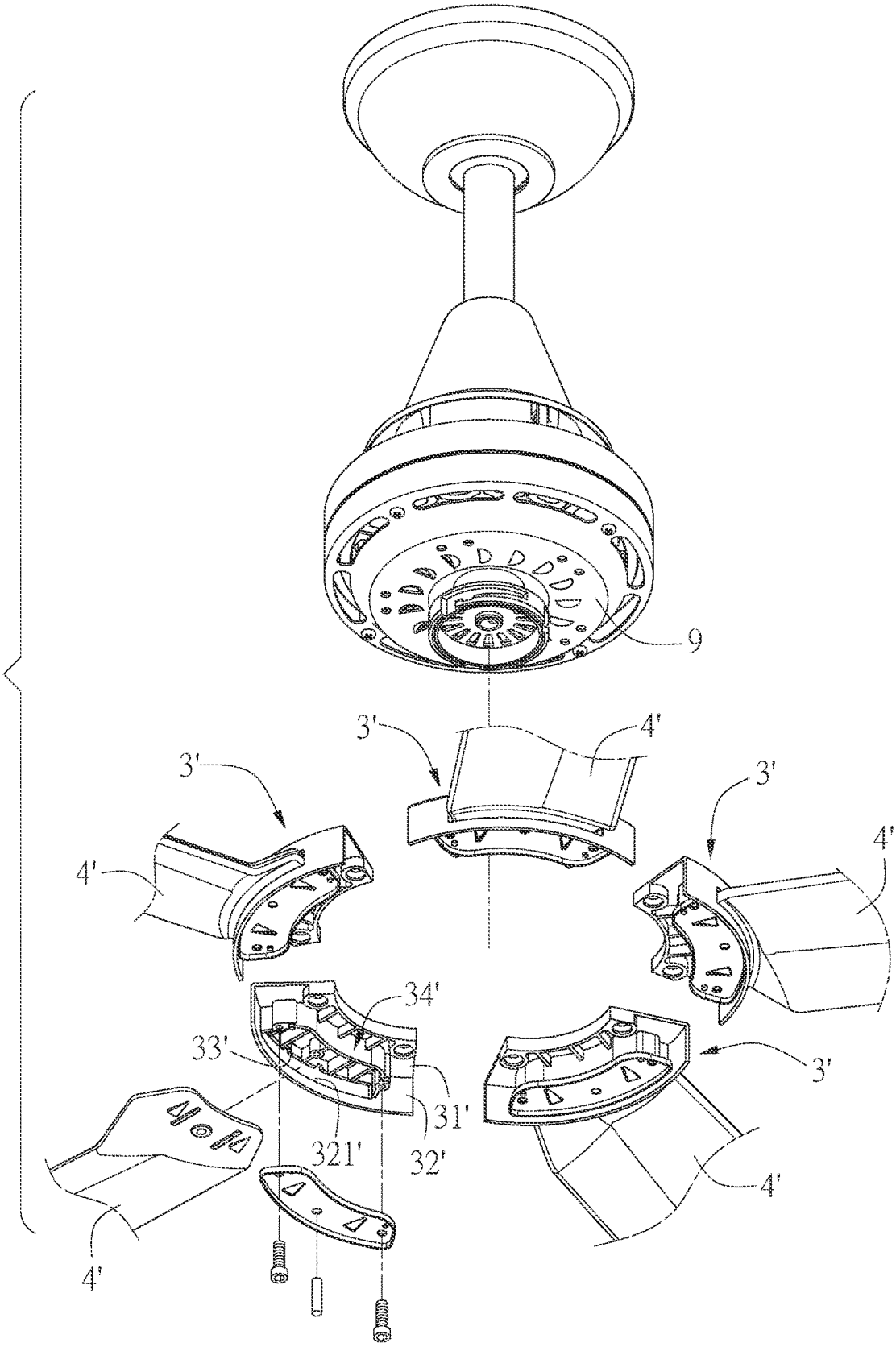
FIG. 4 is a perspective exploded view of the present disclosure, wherein the base is replaced with another embodiment.

The base further has another structure embodiment as shown in FIG. 4. The base 3 ' is fan-shaped, and the bottom wall 31' of the base 3 ' is provided with a guide rail part 33' and two fixing frames 34 ', and the front wall 32' is provided with an insertion opening 321 ' for assembling one fan blade 4'. A corresponding number of bases 3' can be determined according to the number of fan blades 4', and the bases 3' are fixed on the motor 9 of the ceiling fan.

The fan blade 4 defines a tongue part 41 coupled to the base 3, the tongue part 41 is inserted from the insertion opening 321 and moves along the guide rail part 33, and extends below the top plate 342. One side of the tongue part 41 is provided with two protrusions 42 extending in the insertion direction, and on the other hand, two recesses part 322 corresponding to the protrusions 42 are provided at the periphery of the insertion opening 321, and the tongue part 41 can only insert the insertion opening 321 in the direction of the protrusions 42 corresponding to the recesses part 322, thereby fool-proof effect of wrongly inserting can be achieved.

Figure 5:
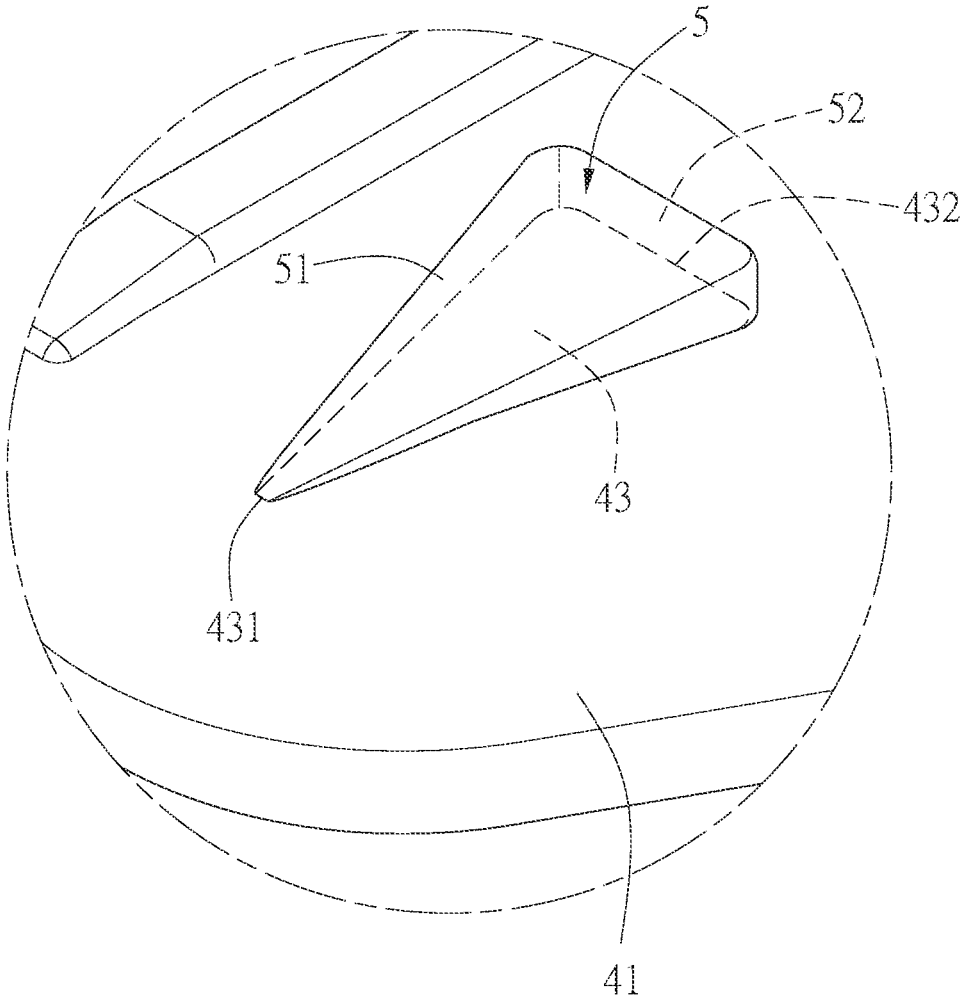
FIG. 5 is an enlarged schematic view of part A in FIG. 3.

The tongue part 41 is provided with two bases area 43, as shown in FIG. 5, in the present embodiment, the base area 43 forms a triangular shape having a tip 431 and a straight section 432 opposite to the tip 431, wherein the tip 431 is in front of the insertion direction. A stop block 5 is integrally erected on the base area 43, the height of the stop block 5 is gradually increased from the tip 431 to the straight section 432 so that a wedge face 51 can be formed, the highest position of the wedge face 51 is higher than the bottom face of the top plate 342, and the stop block 5 has an upright face 52 at the straight section 432. On the other hand, the top plate 342 is provided with two through holes whose shapes respectively corresponding to the stop block 5.

Figure 6:
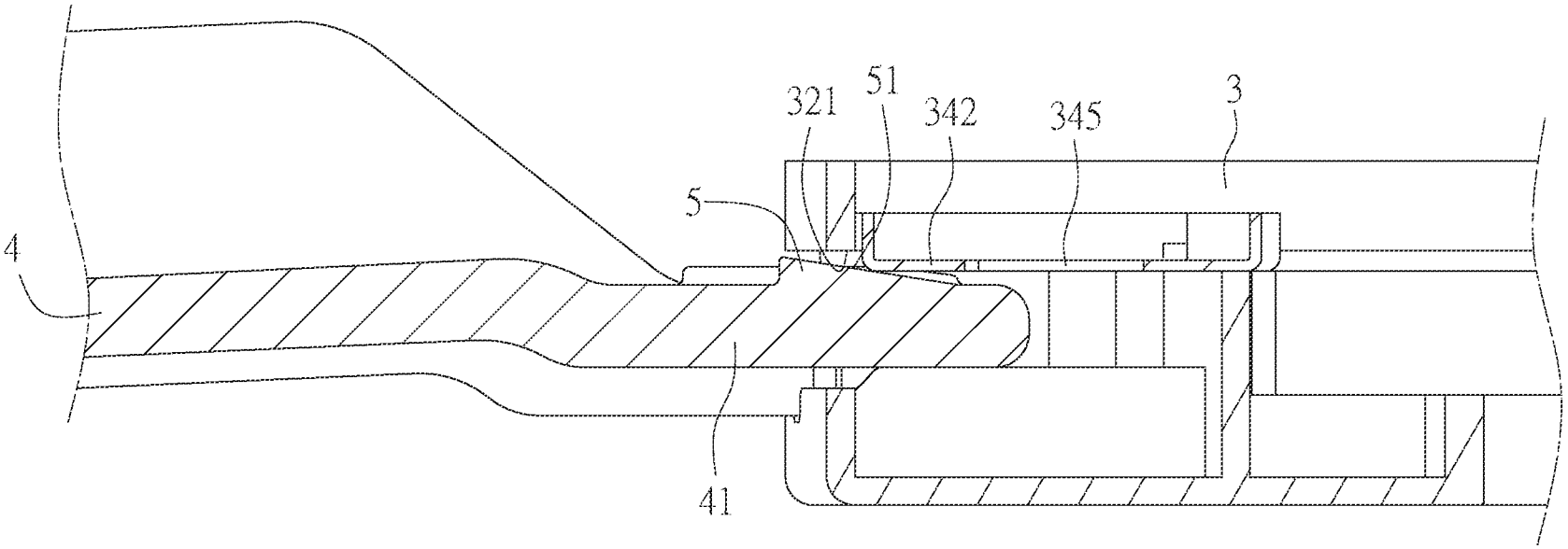
FIGS. 6 and 7 are schematic diagrams of assembly actions of the present disclosure.
Figure 7:
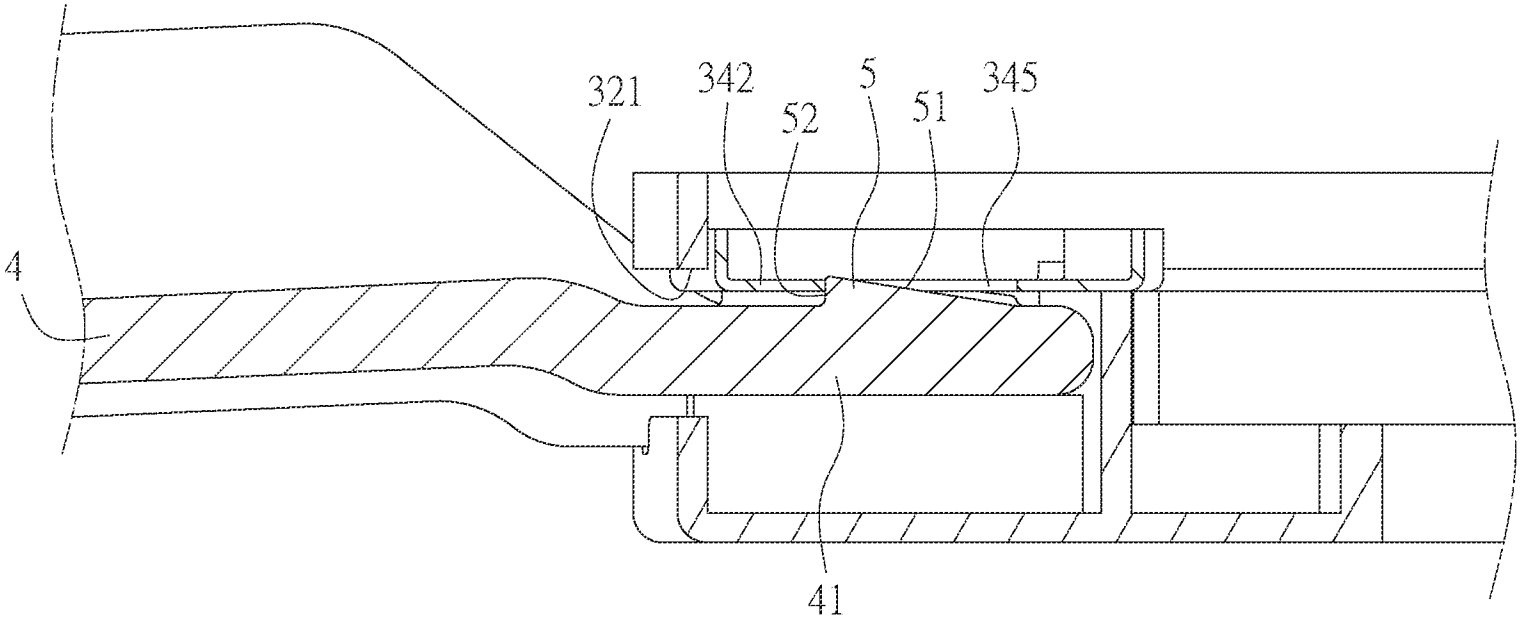
Figure 8:
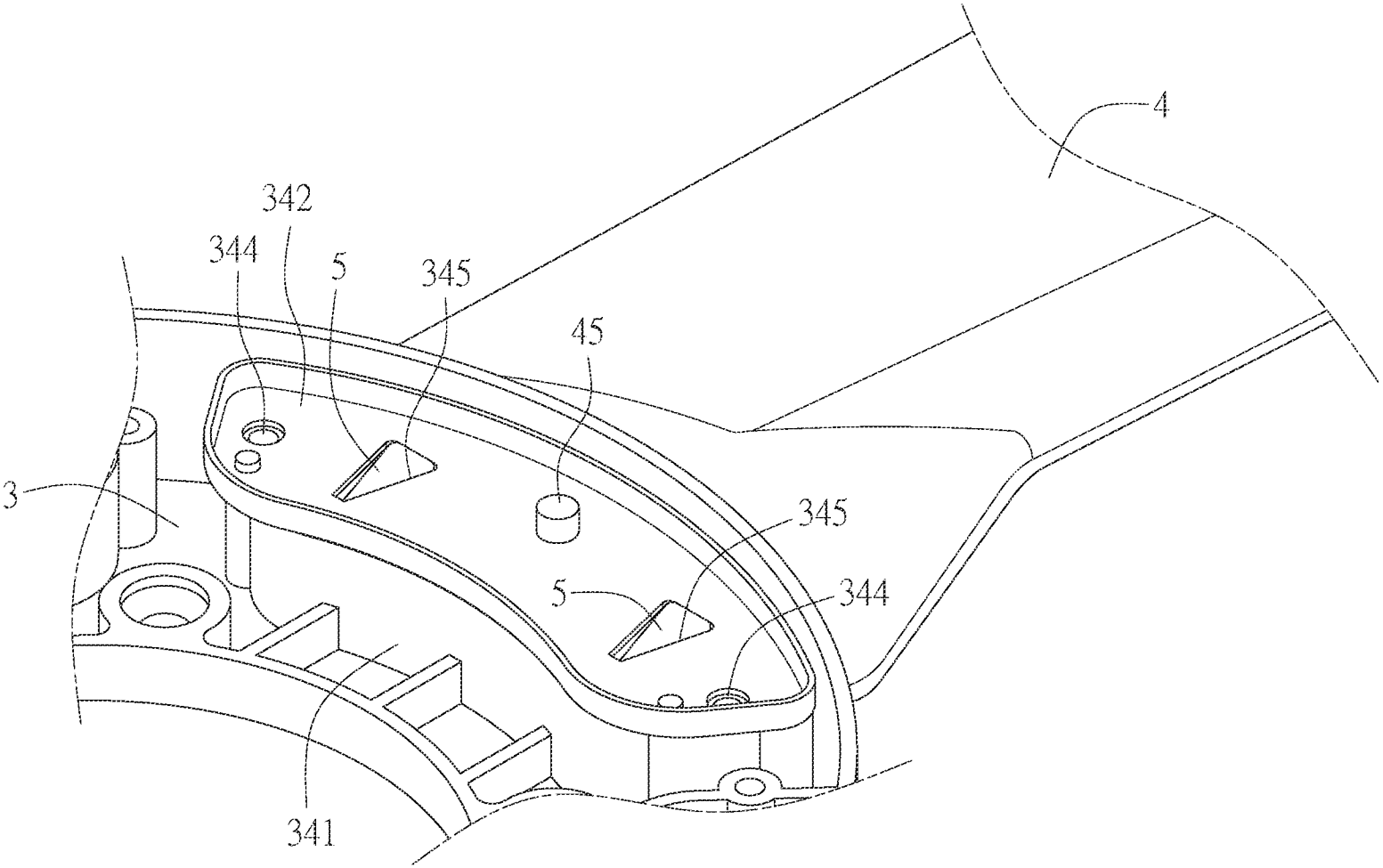
FIG. 8 is a schematic perspective view of a combination of the present disclosure after combination.

When the fan blade 4 is inserted into the insertion opening 321 of the base 3 with the tongue part 41, as shown in FIGS. 6 and 7, firstly, the wedge face 51 of the stop block 5 abuts against the bottom face of the top plate 342, and then squeeze the blade with outer force, so that the wedge face 51 can be used to guide the stop block 5 to pass below the top plate 342. When the stop block 5 moves to the through hole 345, as shown in FIG. 8, the stop block 5 penetrates through the through hole 345 and abuts against the rear edge of the through hole 345, so that a blocking effect is generated because of the height difference between the stop block 5 and the through hole 345, which prevent the fan blade 4 from exiting from the insertion port 321.

Further, the top plate 342 and the guide rail part 33 are respectively provided with a positioning hole 346, 331, and the tongue part 41 of the fan blade 4 is provided with a through hole 44 aligned with the positioning hole 346, 331, so that the fan blade 4 can pass through the positioning hole 346 and the through hole 44 and locked in the positioning hole 331, so as to ensure that the fan blade 4 is fixed on the base 3, in order to prevent the fan blade 4 from flying out due to centrifugal force during rotation.

What is claimed is:

1. A quick buckle structure of a ceiling fan blade, the quick buckle structure comprises:

a base fixed on a rotor of the fan motor, wherein the base is provided with a bottom wall and a front wall, the front wall is provided with an insertion opening, the bottom wall is provided with a guide rail part adjacent to the insertion opening, and a fixing frame located behind the guide rail is arranged on the bottom wall; and a blade, which is inserted into the insertion opening with a tongue part, wherein the tongue part extends along the guide rail, the tongue part is provided with a base area located behind the fixing frame, a stop block is integrally erected on the base area, and the stop block abuts against the fixing frame so that the fan blade cannot exit from the insertion opening, wherein the fixing frame comprises a bottom part integrally connected to the bottom wall, and a top plate locked to the bottom part by a screw, and the stop block abuts against the top plate so that the fan blade cannot exit from the insertion opening.

2. The quick buckle structure of the ceiling fan blade of claim 1, wherein a recess part is provided at the periphery of the insertion opening, and the tongue part of the fan blade is provided with a protrusion whose position and shape correspond to the recess part so that the tongue part can be inserted into the insertion opening in a specific orientation.

3. The quick buckle structure of the ceiling fan blade of claim 1, wherein the fan blade passes through the tongue part with a bolt and is locked to the guide rail part.

4. The quick buckle structure of the ceiling fan blade of claim 1, the stop block is provided with a wedge face facing the insertion direction of the tongue part, and an upright face facing away from the insertion direction of the tongue part, in the process of inserting the tongue part into the insertion opening, the wedge face abuts against the top plate and guides the stop block to pass through the top plate, and the upright face is blocked by the top plate after passing through the top plate so that the fan blade cannot exit from the insertion opening.

5. The quick buckle structure of the ceiling fan blade of claim 4, wherein the top plate is provided with a through hole, and the upright face of the stop block extends into the through hole and abuts against a hole edge of the through hole.

* * * * *